US007368673B2

(12) United States Patent
Sato

(10) Patent No.: US 7,368,673 B2
(45) Date of Patent: May 6, 2008

(54) MULTI DIRECTIONAL INPUT APPARATUS

(75) Inventor: Yasuhiro Sato, Tokyo (JP)

(73) Assignee: Niles Co., Ltd. (JP)

( * ) Notice: Subject to any disclaimer, the term of this patent is extended or adjusted under 35 U.S.C. 154(b) by 0 days.

(21) Appl. No.: 11/498,152

(22) Filed: Aug. 3, 2006

(65) Prior Publication Data

US 2007/0029173 A1 Feb. 8, 2007

(30) Foreign Application Priority Data

Aug. 5, 2005 (JP) ..... P2005-228754
Aug. 5, 2005 (JP) ..... P2005-228755

(51) Int. Cl.
*H01H 25/04* (2006.01)

(52) U.S. Cl. ..... 200/5 R

(58) Field of Classification Search ..... 200/4, 200/5 R, 17 R, 18, 14; 341/20, 35; 345/156–163, 345/184

See application file for complete search history.

(56) References Cited

U.S. PATENT DOCUMENTS

| | | | | |
|---|---|---|---|---|
| 5,613,600 | A * | 3/1997 | Yokoji et al. | 200/564 |
| 6,329,898 | B1 * | 12/2001 | Mizobuchi | 338/162 |
| 6,636,197 | B1 * | 10/2003 | Goldenberg et al. | 345/156 |
| 6,867,379 | B2 * | 3/2005 | Hayashi | 200/4 |
| 6,953,900 | B2 * | 10/2005 | Sottong | 200/5 R |
| 7,068,259 | B2 * | 6/2006 | Kim et al. | 345/169 |
| 7,193,166 | B2 * | 3/2007 | Sakurai et al. | 200/5 R |
| 7,214,894 | B1 * | 5/2007 | Kakuno et al. | 200/6 A |
| 7,227,090 | B2 * | 6/2007 | Kakuno et al. | 200/6 A |
| 7,242,390 | B2 * | 7/2007 | Bader et al. | 345/161 |

FOREIGN PATENT DOCUMENTS

| | | | |
|---|---|---|---|
| DE | 200 14 425 | U1 | 2/2001 |
| DE | 102004038311 | A1 * | 3/2005 |
| EP | 1 426 991 | A1 | 6/2004 |
| JP | 2005-122289 | A | 5/2005 |
| JP | 2005-122290 | A | 5/2005 |
| JP | 2005-122294 | A | 5/2005 |
| WO | WO 93/18475 | | 9/1993 |
| WO | WO 02/089047 | A1 | 11/2002 |

OTHER PUBLICATIONS

European Search Report; Application No. EP 06 01 6189; Dated: Nov. 8, 2006.

* cited by examiner

*Primary Examiner*—Michael A Friedhofer
(74) *Attorney, Agent, or Firm*—Rader Fishman & Grauer PLLC; Ronald P. Kananen

(57) ABSTRACT

A knob for performing a parallel operation, a rotational operation and a pushing operation relative to a case, a first rotor disposed rotatably to the case, a second rotor positioned face to face and adjacent to the first rotor in the direction of a knob rotational axis and disposed rotatably to the case and movable in a rotational, radial direction such that the knob performs the pushing operation in the direction of the knob rotational axis and makes rotational engagement to the second rotor, and a positioning engagement portion disposed between the first and the second rotor and disengaged against urging forces to allow movement of the second rotor in the direction of the knob rotational axis relative to the first rotor and perform rotational transmission between the first and the second rotor are provided. A detecting portion corresponding to any one of the parallel operation, the rotational operation and the pushing operation is activated based upon the operation.

18 Claims, 9 Drawing Sheets

MULTI DIRECTIONAL INPUT APPARATUS

CROSS-REFERENCE TO RELATED APPLICATION

This application is based on Japanese Patent Application No. 2005-228754 and 2005-228755 both filed on Aug. 5, 2005, the disclosure of which is incorporated herein by reference.

BACKGROUND OF THE INVENTION

1. Field of the Invention

The present invention relates to a multi directional input apparatus and in particular, to a multi directional input apparatus for an automobile which can perform a parallel operation, a rotational operation and a pushing operation.

2. The Related Art of the Invention

FIG. 9 is a major cross-sectional view showing a conventional multi directional input apparatus. As shown in FIG. 9, the conventional multi directional input apparatus is so constructed that an inclining and pushing operation knob 203 is attached to a case 201 in such a manner as to be capable of performing an inclining operation and a pushing operation and a rotational knob 204 is attached to the case 201 in such a manner as to perform a rotational operation, where associated contact points operate due to each operation.

The inclining operation of the inclining and pushing operation knob 203 causes inclination of an oblique member 205, operating the contact point. The rotational operation of the rotational knob 204 causes rotation of a rotational body 207 together therewith, detecting the rotation. The pushing operation of the inclining and pushing knob 203 causes a pushing member 209 to axially be pushed down, operating the contact point.

SUMMARY OF THE INVENTION

When in the conventional structure, however, the inclining operation or the pushing operation of the inclining operation knob 203 is transferred to the rotational operation of the rotational knob 204, it is required to replace the knob 203 with the knob 204 for holding (refer to JP-A-2005-122294, 2005-122289 and 2005-122290).

In view of the above, there exists a need for a multi directional input apparatus for an automobile which overcomes the above-mentioned problem in the related art. The present invention addresses this need in the related art as well as other needs, which will become apparent to those skilled in the art from this disclosure.

The present invention has been made from the foregoing problem and an object of the present invention is to provide a multi directional input apparatus which includes two rotors and a positioning engagement portion to be engaged/disengaged, where a parallel operation, a rotational operation and a pushing operation of a knob can be performed without replacing one knob with the other knob for holding.

A multi directional input apparatus according to an aspect of the present invention includes a knob capable of performing a parallel operation, a rotational operation and a pushing operation relative to a case, a first rotor disposed rotatably to the case, a second rotor positioned face to face and adjacent to the first rotor in the direction of a knob rotational axis and disposed rotatable to the case and movable to a rotational, radial direction such that the knob performs a pushing operation in the direction of the knob rotational axis and makes rotational engagement to the second rotor, and a connecting member disposed between the first rotor and the second rotor to allow movement of the second rotor in the direction of the knob rotational axis relative to the first rotor and perform rotational transmission between the first rotor and the second rotor, thereby activating a detecting portion corresponding to any one of the parallel operation, the rotational operation and the pushing operation, based upon the operation.

As a result, the multi directional input apparatus can, in order to activate a detecting portion, perform a parallel operation, a rotational operation and a pushing operation of a knob without replacing one knob with the other knob for holding.

These and other objects, features, aspects and advantages of the present invention will be become apparent to those skilled in the art from the following detailed description, which, taken in conjunction with the annexed drawings, discloses preferred embodiments of the present invention.

BRIEF EXPLANATION OF THE DRAWINGS

Referring now to the attached drawings which form a part of this original disclosure.

DETAILED DESCRIPTION OF THE PREFERRED EMBODIMENT

Selected preferred embodiments of the present invention will now be explained with reference to the drawings. It will be apparent to those skilled in the art from this disclosure that the following description of the embodiments of the present invention is provided for illustration only, and not for the purpose of limiting the invention as defined by the appended claims and their equivalents.

First Preferred Embodiment

[Structure of Multi Directional Switch]

Figure 1:
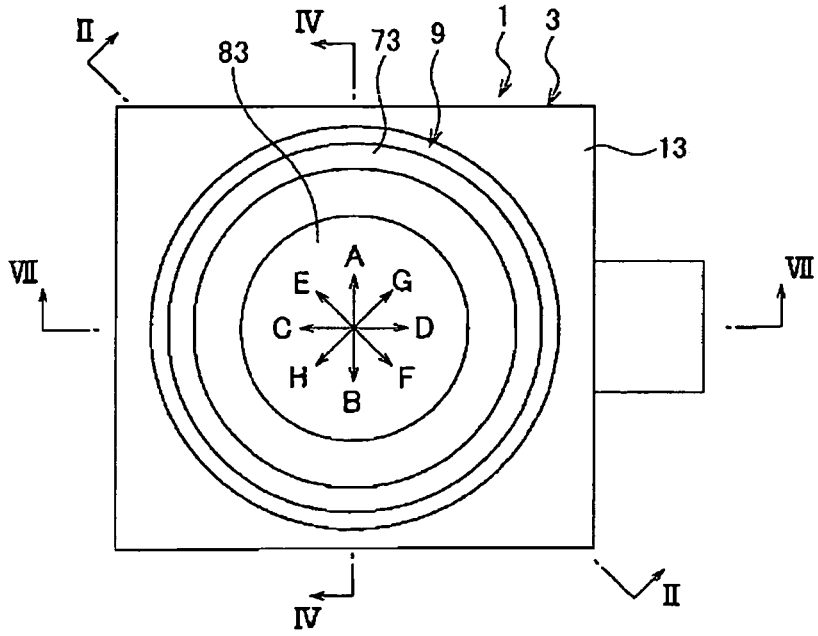
FIG. 1 is a plan view showing a multi directional switch in a first preferred embodiment of the present invention.
Figure 2:
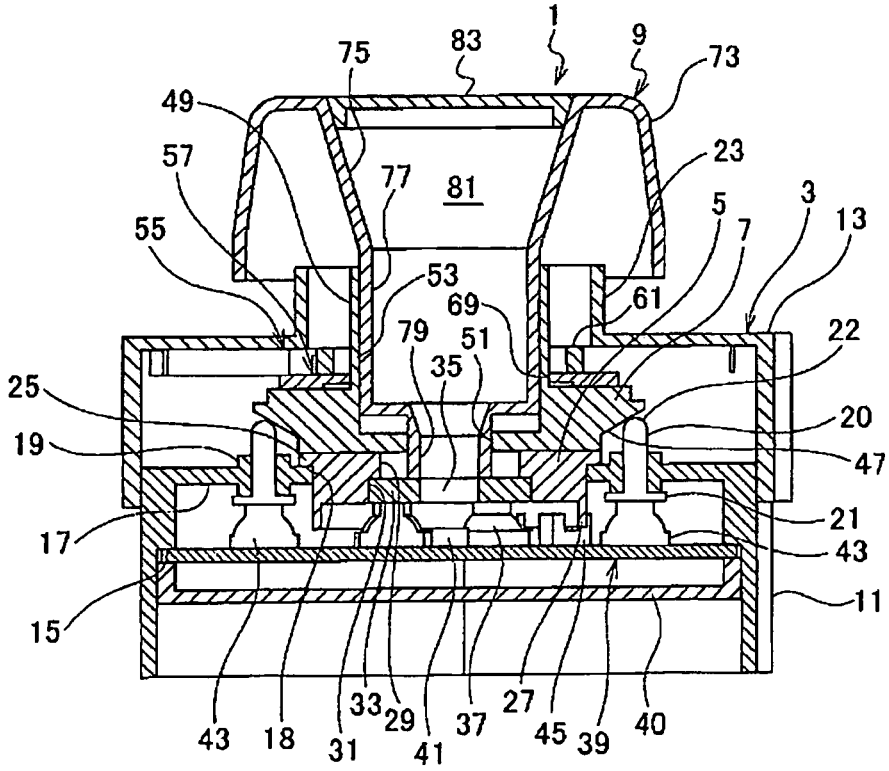
FIG. 2 is a cross section taken in the direction of the arrows on lines 2-2 of FIG. 1.

FIGS. 1 to 8 show a first preferred embodiment. Referring to FIGS. 1 and 2, a multi directional switch 1 as a multi direction input apparatus in a first embodiment of the present invention is equipped with a case 3 including a first rotor 5, a second rotor 7, a knob 9 and the like, where the knob 9 is capable of performing a parallel operation, a rotational operation and a pushing operation, thereby activating a detecting portion corresponding to any one thereof. It should be noted that in the following explanation, the direction of the rotational axis of the knob 9 is denoted by the knob rotational axis direction, the rotational radial direction of the knob 9 is denoted by the knob rotational radial direction, and the rotational, circumferential direction of the knob 9 is denoted by the knob circumferential direction.

The case 3 is formed of a lower case 11 and an upper case 13 and is in a square shape on a plane. A lower part of the upper case 13 is fitted into an upper part of the lower case 11 and they are jointed and fitted with each other by snatch fitting in such a manner as to be engaged/disengaged. A shoulder 15 for substrate positioning is provided on an inside face of the lower case 11. A rotor support bore 18 is formed in a top plate 17 of the lower case 11. Rod support portions 19 are provided in the top plate 17 at four locations of the knob circumferential direction at the outer periphery of the rotor support bore 18. Push rods 20 are supported by the rod support portions 19. A flange 21 is formed in the push rod 20 and is engaged to the rod support portion 19. A tip 22 of the push rod 20 is shaped smoothly in a semi sphere. A tubular portion 23 is formed in the upper case 13.

The first rotor 5 is attached rotatably to the case 3. That is, the first rotor 5 is formed in a doughnut shape and is supported rotatably in the rotor support bore 18 of the lower case 11. A flange 25 is formed at the one-side circumference of the first rotor 5 and a comb tooth-shaped portion 27 for rotation detection is formed at the other-side circumference. The flange 25 is engaged to the top plate 17 of the lower case 11. A through bore 29 is formed in the central portion of the first rotor 5 and a push plate support bore 31 is adjacent to the through bore 29.

A push plate 33 is movably supported in the push plate support bore 31. The push plate 33 includes a through bore 35 formed therein, having a doughnut shape. A rubber contact 37 is in contact with the push plate 33 to operate as a detecting portion in response to a pushing operation. When the rubber contact 37 receives pushing forces from the push plate 33, it flexibly deflects to activate a contact point. The rubber contacts 37 are arranged on a substrate 39 at three locations in the knob circumferential direction at intervals of 120 degrees.

The substrate 39 is fitted into the shoulder 15 of the lower case 11 and positioned by a stopper 40 attached to the lower case 11.

A LED 41 is located as an illuminator to the substrate 39, as opposed to the through bore 35. A rubber contact 43 is disposed at the outer periphery side of the rubber contact 37 to serve as a detecting portion in response to a parallel operation of the knob 9. The rubber contact 43 is disposed at each of four locations in the knob circumferential direction to contact the flange 21 of the push rod 20. A photo sensor 45 is further disposed on the substrate 39 to serve as a detecting portion in response to a rotational operation of the knob 9. The photo sensor 45 may be replaced by a different rotational detecting sensor.

Accordingly, the multi directional switch 1 is configured to have the single substrate 39 equipped with the detecting portions which individually operate based upon the parallel operation, the rotational operation and the pushing operation of the knob 9.

The second rotor 7 is positioned face to face and adjacent to the first rotor 5 in the knob rotational axis direction and is disposed rotatably to the case 3 and movably in the knob rotational radial direction. A positioning engagement portion, which will be described later, allows the movement of the second rotor 7 in the knob rotational radial direction relative to the first rotor 5, as well as rotational transmission between the first and the second rotor 5 and 7.

A tapered face 47 is formed at the one-side periphery of the second rotor 7 and is in contact with the tip 22 of the push rod 20. A support cylinder 49 is disposed at the other-side face of the second rotor 7. A through bore 51 is formed in the central portion of the second rotor 7 and a joint bore 53 is disposed adjacent to the through bore 51 and in the inner periphery of the support cylinder 49.

A first and second sliders 55 and 57 and a rotational adjustment engagement portion to be described later are arranged between the second rotor 7 and the upper case 13 and the second rotor 7 is rotatable and movable in the knob rotational radial direction to the upper case 13 of the case 3. The first slider 55 is movable in one direction to the upper case 13 of the case 3 and also the second slider 57 is movable to the first slider 55 in the direction perpendicular to the one direction.

Figure 3:
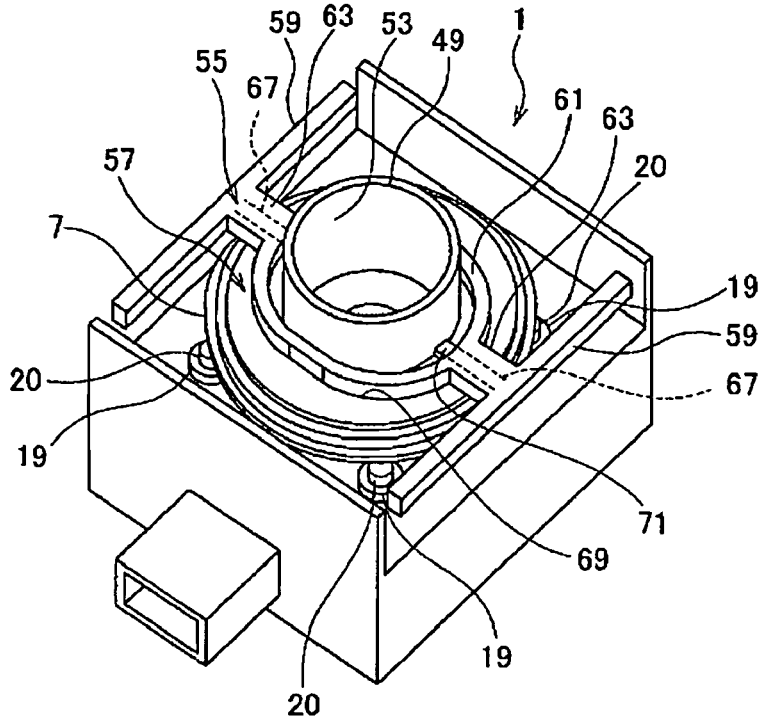
FIG. 3 is a perspective view showing the multi directional switch dismantling a knob and an upper case from the switch in the first preferred embodiment.
Figure 4:
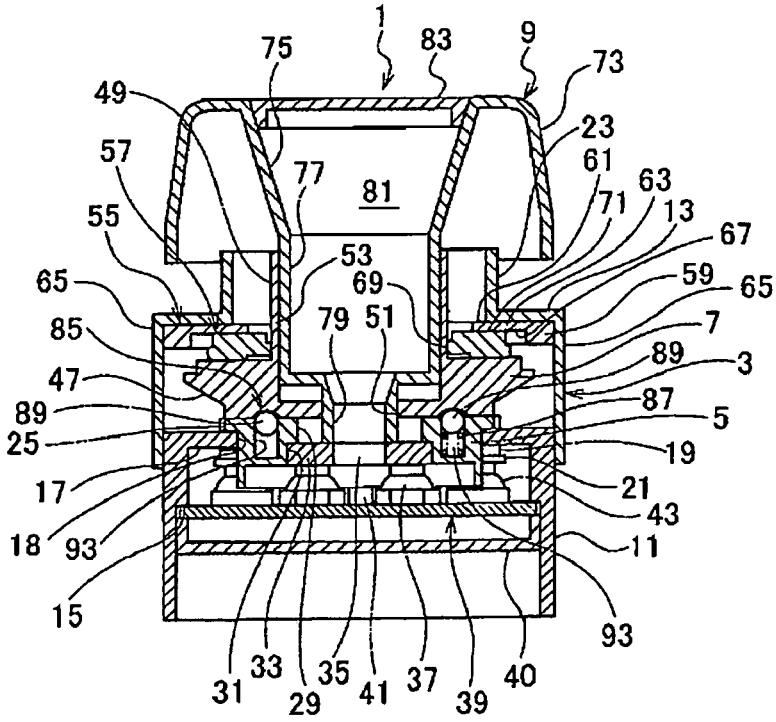
FIG. 4 is a cross section taken in the direction of the arrows on lines 4-4 of FIG. 1.
Figure 5:
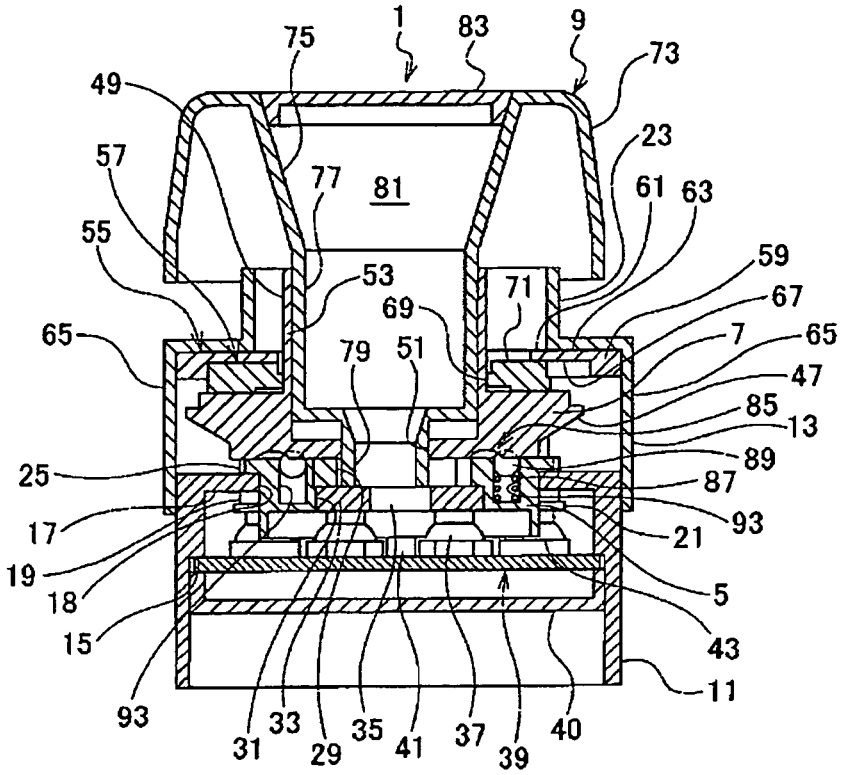
FIG. 5 is a cross section showing a parallel operation of the knob and corresponding to FIG. 4.

The first slider 55, as shown in FIG. 3, is equipped with a pair of slide arms 59 and a ring portion 61. The slide arms 59 and the ring portion 61 are jointed by a bridge portion 63 to form the H configuration on a plane. The slide arm 59 is guided in the inner face of the side wall 65 of the upper case 13 to move in one direction as shown in FIGS. 4 and 5. A slide groove 67 is formed in the first slider 55 across the bridge portion 63 to the slide arm 59 as shown in FIG. 3.

The second slider 57 is provided with a fitting bore 69 formed at the central portion and is formed in a ring shape. The second slider 57 is fitted into the fitting bore 69 in such a manner as to move relatively to the support cylinder 49 of the second rotor 7. The second slider 57 is provided with a projecting portion 71 fitted slidably into the slide groove 67 of the first slider 55. A space may be provided between the slide groove 67 and the projecting portion 71 for fitting a grease pool or an oleoresin therein. An oblique face is formed in the slider 57, having the same function as the tapered face 47 in place of the tapered face 47 of the second rotor 7.

The knob 9 is attached to the second rotor 7 in such a manner as to perform the pushing operation in the knob rotational axis direction and be rotatably engaged thereto. The knob 9 has a grip 73 which is sized and configured to be gripped with, for example, a hand. The knob 9 is equipped with a conical portion 75, a body portion 77 and a tip 79 and includes a hollow portion 81, having a cross section of a circle and formed with them to penetrate through in the knob rotational axis direction. A face plate 83 made of a translucent material is provided at an end of the conical portion 75 and constitutes a display. The hollow portion 81 of the knob 9 and the through bore 35 of the push plate 33 constitute an optical path penetrating from the LED 41 to the face plate 83. Illumination of the LED 41 causes an illuminating display of the face plate 83.

Figure 6:
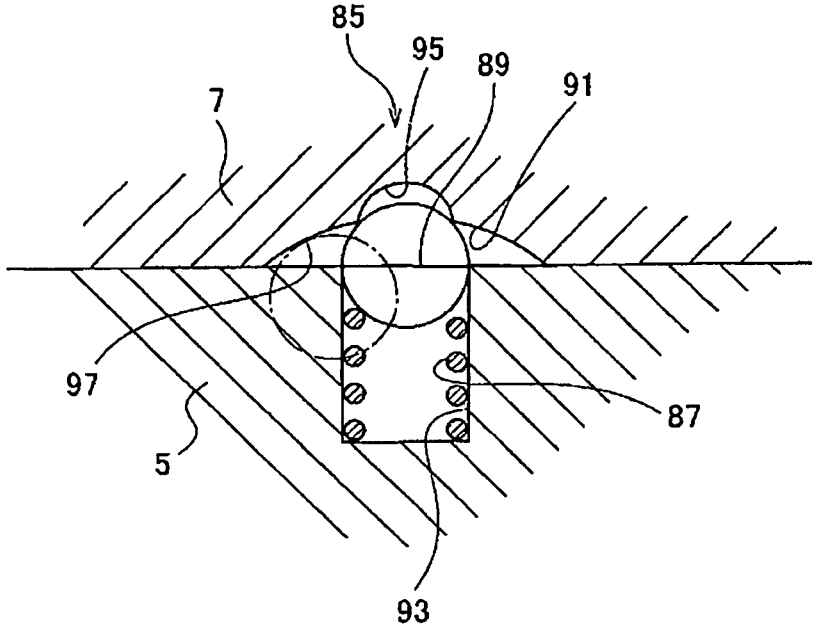
FIG. 6 is a partial cross section showing a positioning engagement portion between a first rotor and a second rotor in the first preferred embodiment.

The knob 9 is inserted into the support cylinder 49 of the second rotor 7 and is rotatably engaged to the second rotor 7 in such a manner as to perform a pushing operation to the second rotor 7. This engagement can be made, for example, by engagement of a projection formed in the body portion 77 of the knob 9 to a slit formed in the knob rotational axis direction of the support cylinder 49. The engagement of the projection to the slit is made by snap fitting, preventing the knob 9 from coming off the second rotor 7. The positioning engagement portion between the first and the second rotor 5 and 7 is made as shown in FIGS. 4 to 6. The positioning engagement portion 85 can be disengaged against a spring force and is formed of a ball 89 urged by a coil spring 87 located in the first rotor 5 as one of the first and second rotors 5 and 7 and an adjustment recess 91 formed in the second rotor 7 as the other and engaged to the ball 89. The coil spring 87 and the ball 89 may be disposed in the second rotor 7 and the adjustment recess 91 may be formed in the first rotor 5.

The coil spring 87 and the ball 89 are received in each of receiving holes 93 formed at a plurality of locations in the knob circumferential direction of the first rotor 5 and each ball 89 flexibly contacts the adjustment recess 91 formed in the second rotor 7.

The adjustment recess 91 is formed in a step shape, as composed of a central, positioning recess 95 and a returning recess 97 around the positioning recess 95.

Figure 7:
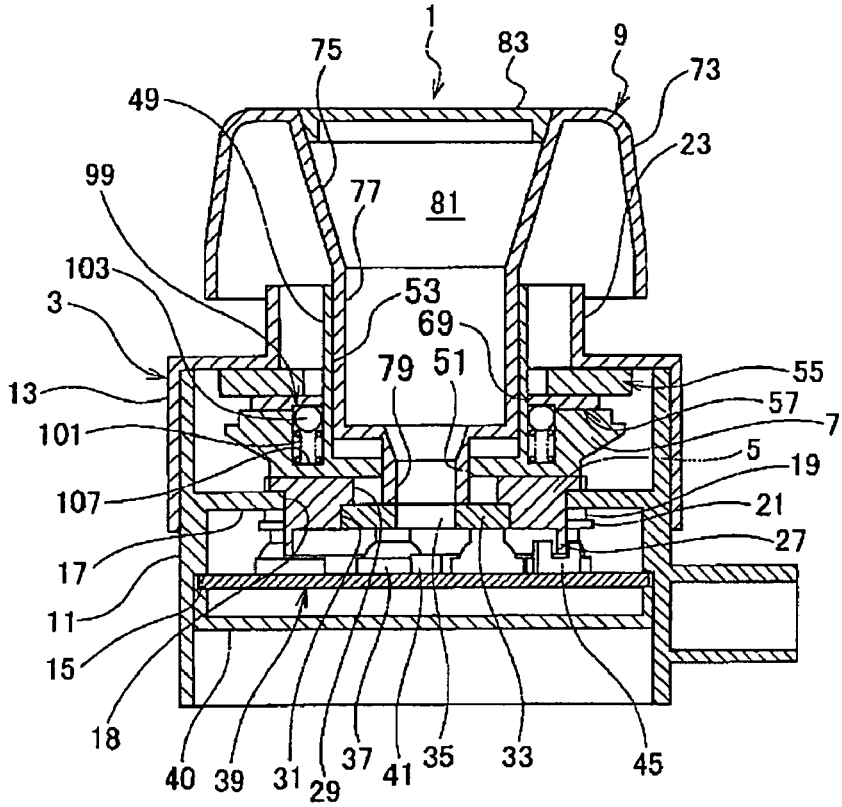
FIG. 7 is a cross section taken in the direction of the arrows on lines 7-7 of FIG. 1.
Figure 8:
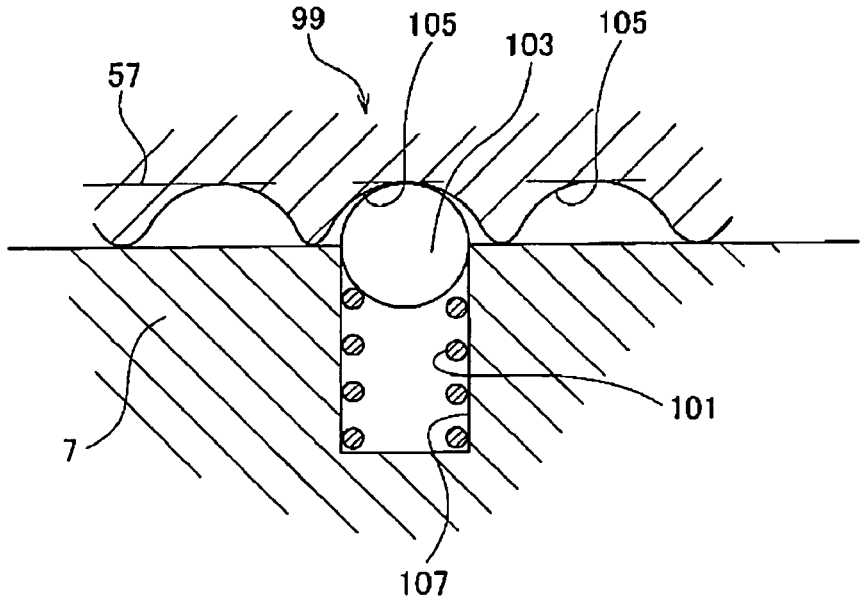
FIG. 8 is a partial cross section showing a rotational adjustment engagement portion between a second slider and the second rotor in the first preferred embodiment.
Figure 9:
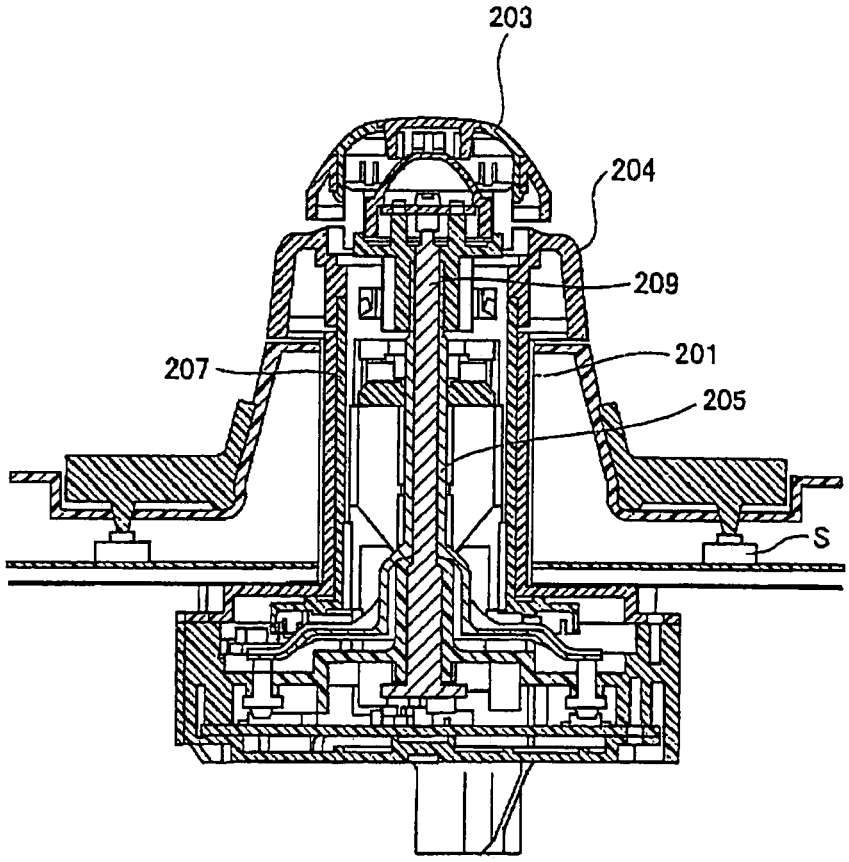
Fig.9 PRIOR ART
FIG. 9 is a major cross section showing a conventional multi directional switch.

The rotational adjustment engagement portion is, as shown in FIGS. 7 and 8, provided between the second rotor 7 and the second slider 57 to provide a rotational adjustment of the second rotor 7 to the second slider 57. The rotational adjustment engagement portion 99 is formed of a ball 103 urged by a coil spring 101 located in the second rotor 7 as one of the second rotor 7 and the second slider 57 and an adjustment recess 105 formed in the second slider 57 as the other and engaged to the ball 103. The coil spring 101 and the ball 103 may be disposed in the second slider 57 and the adjustment recess 105 may be formed in the second rotor 7.

The coil spring 101 and the ball 103 are received in each of receiving holes 107 formed at a plurality of locations in the knob circumferential direction of the second rotor 5 and each ball 103 flexibly contacts the adjustment recess 105 formed sequentially in the knob circumferential direction in the second slider 57.

[Parallel Operation]

The grip 73 of the knob 9 is gripped with a hand, performing a parallel operation of the knob 9 in any one of eight directions of A to H in FIG. 1. This operation causes the operation force of the knob 9 to be transmitted to the second rotor 7 through a connecting bore 53. This operation force is transmitted in the order of the second rotor 7, the second slider 57 and the first slider 55. The first slider 55 is guided along the side wall 65 of the upper case 13 for sliding and the second slider 57 slides to the first slider 55 by the slide groove 67 and the projecting portion 71. Cooperation of both slide movements of the first and second slider 55 and 57 controls rotation of the second rotor 7 when the second rotor 7 moves in the knob rotational radial direction to the upper case 13. This rotation control allows the knob 9 to perform only the parallel operation in the knob rotational radial direction including the directions of A to H. In addition, this rotation control causes an effective function of the rotational adjustment engagement portion 99 between the second rotor 7 and the second slider 57.

This parallel operation produces movement of the second rotor 7 from a state of FIG. 4 to a state of FIG. 5. This movement causes the tapered face 47 of the second rotor 7 to push down the push rod 20 and compress the rubber contact 43, thereby activating the contact point. Since the tapered face 47 is formed in the entire circumference of the second rotor 7, even if the knob 9 rotates, the same function can be achieved.

The push rod 20 is located at a pitch of 90 degrees. Therefore, when the knob 9 is operated in the direction of the push rod 20, the contact point in that direction of the rubber contacts 43 turns on. When the knob 9 is operated in the intermediate direction between two push rods 20, the two push rods 20 turn on at the same time. Accordingly, operations in the eight directions can be detected with four rubber contacts 43.

When the second rotor 7 moves as shown in FIG. 5, the ball 89 urged by the coil spring 87 is out of the positioning recess 95 and relatively moves onto the returning recess 97 as shown in a dashed line of FIG. 6. As the ball 89 moves onto the returning recess 97 out of the positioning recess 95, the reaction is provided to the knob 9 to produce an operation adjustment feeling.

The movement of the ball 89 causes the ball 89 to be pushed down into the direction of the receiving hole 93 against the urging force of the coil spring 87. Accordingly, when the operation force of the knob 9 is eliminated, the ball 89 comes out of the receiving hole 93 by the urging force of the coil spring 87 and returns from the returning recess 97 onto the positioning recess 95 for the second rotor 7 to be positioned therein. At the same time the rubber contact 43 compressed by the push rod 20 also flexibly returns and applies the returning force to the tapered face 47 through the push rod 20. Accordingly, the second rotor 7 is securely moved to a neutral position before the parallel operation of the knob 9 is performed and the knob 9 automatically returns back to the previous position before the operation is performed.

[Rotational Operation]

When the knob 9 is operated for rotation by gripping the grip 73 of the knob 9, the rotational force is transmitted from the body portion 77 to the support cylinder 49 of the second rotor 7, so that the second rotor 7 rotates around the axis. The second rotor 7 transmits the rotation to the first rotor 5 through engagement of the positioning engagement portion 85. The rotation of the first rotor 5 causes relative rotational movement of the comb tooth portion 27 to the photo sensor 45. This rotational movement is detected by the photo sensor 45.

At the time of the rotational operation of the knob 9, the second rotor 7 rotates relatively to the second slider 57. Therefore, the ball 103 urged by the coil spring 101 goes over the adjustment recess 105, thereby producing an adjustment feeling.

[Pushing Operation]

When the knob 9 performs a pushing operation, the body portion 77 is pushed down into the support cylinder 49 and moves in the axial direction. The pushing force of the knob 9 is transmitted from the tip 79 to the push plate 33, compressing the rubber contact 37. With this, the rubber contact 37 is activated and the contact point turns on, so that the pushing operation can be detected.

When an operator releases its hand from the knob 9, the pushing force of the rubber contact 37 is eliminated and the knob 9 is pushed up by the spring returning force of the rubber contact 37 through the push plate 33 to be returned. Another spring may be provided for returning the knob 9.

[Illumination]

When the LED 41 emits light, the light passes through the through bore 35 of the plate 33 and the hollow portion 81 of the knob 9 and directly reaches the face plate 83. This light allows the face plate 83 to perform illuminating display.

[Effect of the First Preferred Embodiment]

A parallel operation, a rotational operation and a pushing operation of the knob 9 can be performed without replacing one knob with the other.

The knob 9 can perform the rotational operation and the pushing operation and besides, the parallel operation without the inclining operation. Therefore, it is not required to have the switch structure where the inclining operation becomes artificially close to the parallel operation, making it possible to carry out downsizing of the entire switch structure.

Since the single substrate 39 has the rubber contacts 37 and 43 and the photo sensor 45 as detecting portions thereon which are individually operated by the parallel operation, the rotational operation and the pushing operation of the knob 9, the number of components can be reduced and easy management of mounting components can be made. In addition, the switch structure can be entirely downsized.

Second Preferred Embodiment

Figure 10:
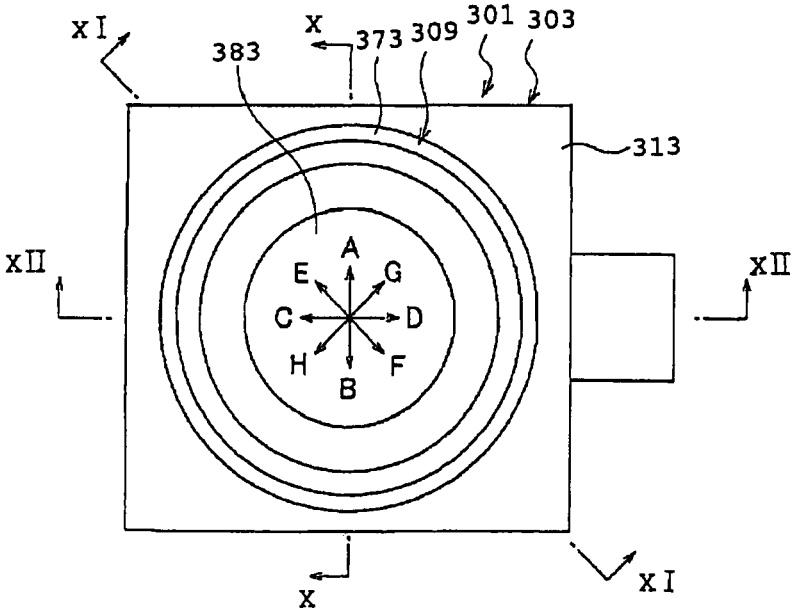
FIG. 10 is a plan view showing a multi directional switch in a second preferred embodiment of the present invention.
Figure 13:
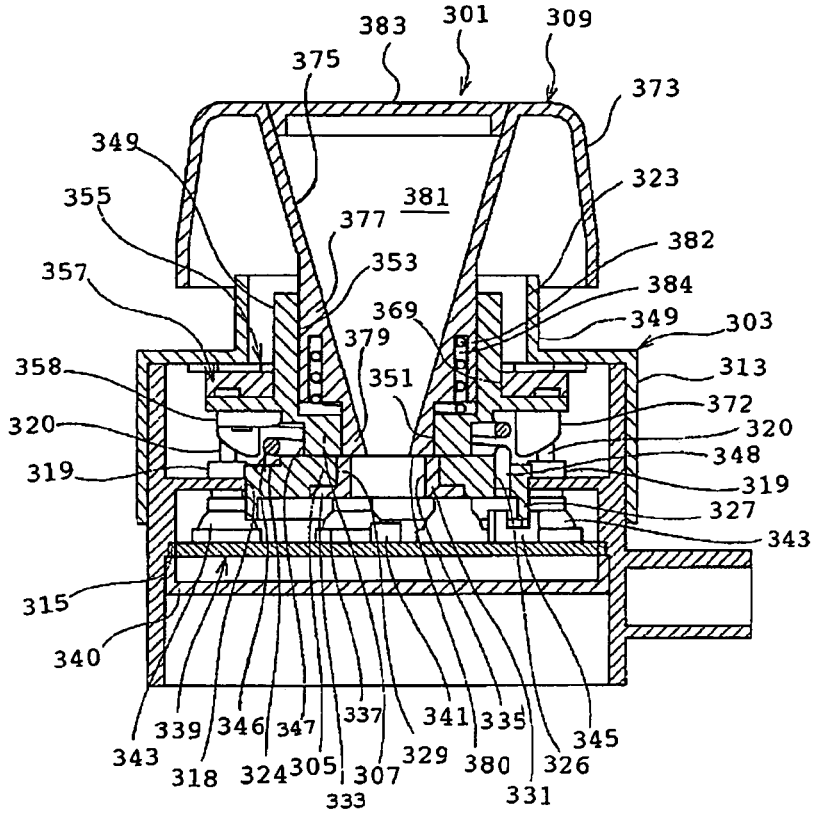
FIG. 13 is a cross section taken in the direction of the arrows on lines 12-12 of FIG. 10.

Referring to FIGS. 10 and 13, a multi directional switch 301 as a multi direction input apparatus in a second embodiment of the present invention is equipped with a case 303 including a first rotor 305, a second rotor 307, a knob 309 and the like, where the knob 309 is capable of performing a parallel operation, a rotational operation and a pushing operation, thereby activating a detecting portion corresponding to any one thereof.

The case 303 is formed of a lower case 311 and an upper case 313 and is in a square shape on a plane. A lower part of the upper case 313 is fitted into an upper part of the lower case 311 and they are jointed and fitted with each other by snatch fitting to be engaged/disengaged. A shoulder 315 for substrate positioning is provided at an inside face of the lower case 311. A rotor support bore 318 is formed in a top plate 317 of the lower case 311. Rod support portions 319 are provided at four locations of the knob circumferential direction in the outer periphery of the rotor support bore 318. Push rods 320 are supported by the rod support portions 319. A flange 321 is formed in the push rod 320 and is engaged to the rod support portion 19. A tip 322 of the push rod 320 is shaped smoothly in a semi sphere. A tubular portion 323 is formed in the upper case 313.

The first rotor 305 is attached rotatably to the case 303. That is, the first rotor 305 is formed in a doughnut shape and is supported rotatably in the rotor support bore 318 of the lower case 311. The first rotor 305 is provided with a spring fitting portion 324 formed at the one-side center and a spring retaining bore 326 (FIG. 13) adjacent to the spring fitting portion 324. A flange 325 is formed at the one-side circumference of the first rotor 305 and a comb tooth-shaped portion 327 for rotation detection is formed at the other-side circumference. The flange 325 is engaged to the top plate 317 of the lower case 311.

The first rotor 305 includes a through bore 329 formed at the central portion, and a push plate 331 as a push member is supported in the through bore 329 to move in the knob rotational axis direction. The through bore 329 is formed stepwise. The push plate 331 is equipped with a flange 333 and also is formed in a hollow shape as having a through bore 335, having the same height as that of the through bore 329 of the first rotor 305. The push plate 331 is fitted into this through bore 329.

A rubber contact 337 is in contact with the push plate 331 to operate as a detecting portion in response to a pushing operation. When the rubber contact 337 receives pushing forces from the push plate 331, it flexibly deflects to activate a contact point. The rubber contacts 337 are arranged at three locations in the knob circumferential direction at intervals of 120 degrees to a substrate 339.

The substrate 339 is fitted into the shoulder 315 of the lower case 311 and positioned by a stopper 340 attached to the lower case 311.

A LED 341 is located as an illuminator to the substrate 339, as opposed to the through bore 335. A rubber contact 343 is disposed at the outer periphery side of the rubber contact 337 to serve as a detecting portion in response to a parallel operation thereof. The rubber contact 343 is disposed at four locations in the knob circumferential direction to contact the flange 321 of the push rod 320. A photo sensor 345 is disposed to the substrate 339 to serve as a detecting portion in response to a rotational operation. The photo sensor 345 may be replaced by a different rotational detecting sensor.

Accordingly, the multi directional input switch 1 is structured to have the single substrate 339 equipped with the detecting portions which are individually activated based upon the parallel operation, the rotational operation and the pushing operation of the knob 9.

The second rotor 307' is positioned face to face and adjacent to the first rotor 305 in the knob rotational axis direction and is disposed rotatably and movably in the knob rotational radial direction to the case 303.

There is provided a coil spring 346 as a flexible member which allows the movement of the second rotor 307 in the knob rotational radial direction relative to the first rotor 305, as well as rotational transmission between the first and the second rotor 305 and 307. The coil spring 346 has one end fitted into a spring fitting portion 324 of the first rotor 305 and the other end portion 348 (FIG. 13) projected in the spring axial direction and fitted into a spring stopping bore 326 of the first rotor 305.

The second rotor 307 has an outer diameter 347 at the one side, which is slightly small and a clearance to the coil spring 346. A support cylinder 349 is disposed at the other side of the second rotor 307. A through bore 351 is formed in the central portion of the second rotor 307 and a joint bore 353 is disposed adjacent to the through bore 351 and at the inner periphery of the support cylinder 349. A spring fitting portion 354 is formed in the second rotor 307 and a pair of stoppers 356 are projected adjacent to the spring fitting portion 354. The coil spring 346 has the other end fitted into the spring fitting portion 354 and the end portion 358 projected in the spring radial, outside direction between the stoppers 356 for positioning. Accordingly, the coil spring 346 is connected to the first rotor 305 and both ends thereof are connected to the first and second rotor 305 and 307 respectively. Rotational, adjustment support portions 360 are projected in the second rotor 307 at, for example, four locations at equal intervals in the knob circumferential direction (refer to FIGS. 11, 12 and 14).

A first and second sliders 355 and 357 and a rotational adjustment engagement portion 399, to be described later, disposed in the rotational adjustment support portion 360 are arranged between the second rotor 307 and the upper case 313. The second rotor 307 is rotatable and movable in the knob rotational radial direction to the upper case 313 of the case 303. The first slider 355 is movable in one direction to the upper case 313 of the case 303 and also the second slider 357 is movable in the direction perpendicular to the one direction to the first slider 355.

Figure 11:
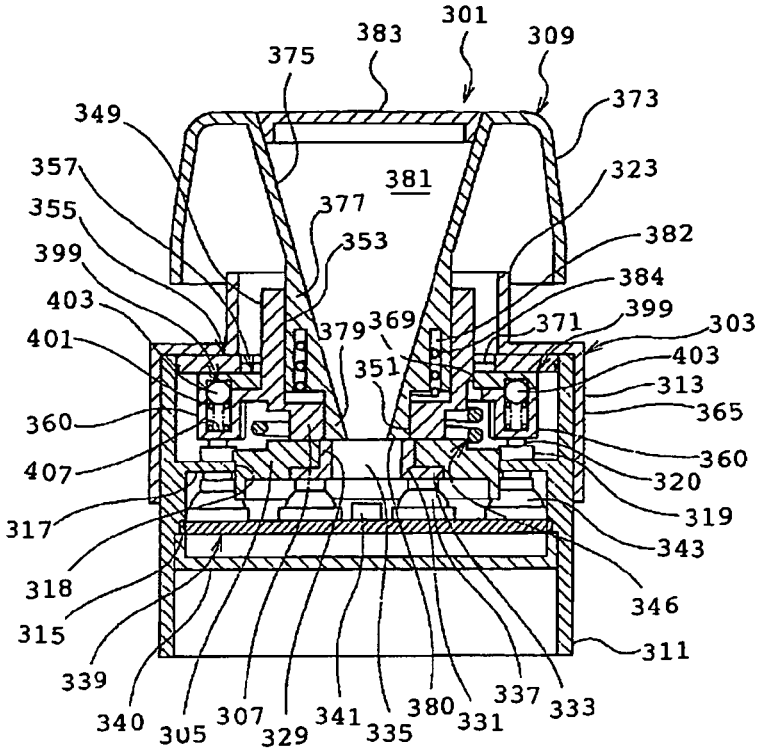
FIG. 11 is a cross section taken in the direction of the arrows on lines 10-10 of FIG. 10.
Figure 12:
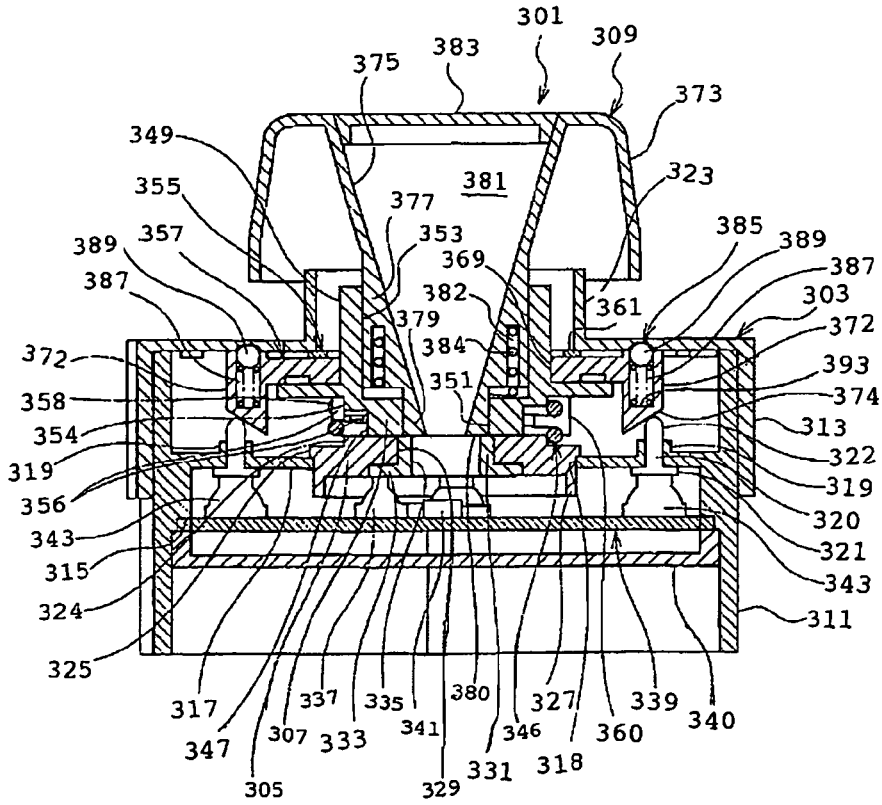
FIG. 12 is a cross section taken in the direction of the arrows on lines 11-11 of FIG. 10.
Figure 14:
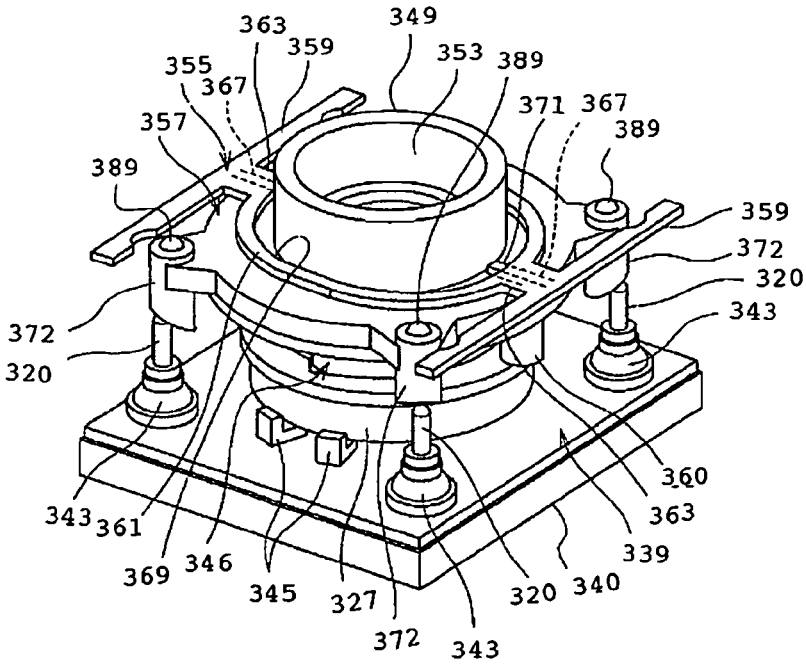
FIG. 14 is a perspective view showing the multi directional switch dismantling a knob, an upper case and a lower case in the second preferred embodiment.

The first slider 355, as shown in FIG. 14, is equipped with a pair of slide arms 359 and a ring portion 361. The slide arms 359 and the ring portion 361 are jointed by a bridge portion 363 to form the H configuration on a plane. The slide arm 359 is guided in the inner face of the side wall 365 of the upper case 313 to move in one direction as shown in FIG. 11. A slide groove 367 is formed in the first slider 355 from the bridge 363 to the slide arm 359 as shown in FIG. 14.

The second slider 357 is provided with a fitting bore 369 formed at the central portion and is formed in a ring shape. The second slider 357 is fitted into the fitting bore 369 in such a manner as to move relatively to the support cylinder 349 of the second rotor 307. The second slider 357 is provided with a projecting portion 371 fitted slidably into the slide groove 67 of the first slider 55. A space may be provided between the slide groove 367 and the projecting portion 371 for fitting a grease pool or an oleoresin therein.

The positioning support portions 327 are projected in the second slider 357 at a plurality of locations, for example, four locations in the knob circumferential direction. The positioning support portion 372 is provided with an oblique face 374 formed therein and is in contact with a tip 322 of the push rod 320. It should be noted that in place of the oblique face 374, a tapered face having the same function as the oblique face 374 may be disposed in the second rotor 307. The positioning support portion 372 is provided with a positioning engagement portion 385 to be described later disposed between the upper case 313 of the case 303 and the second slider 357. The positioning engagement portion 385 allows movement of the second slider 357 to the upper case 313 in the knob rotational radial direction.

The knob 309 is attached to the second rotor 307 in such a manner as to perform the pushing operation in the knob rotational axis direction and be rotatably engaged thereto. The knob 309 has a grip 373 which is sized and configured to be gripped with, for example, a hand. The knob 309 is equipped with a conical portion 375, a body portion 377 and a tip portion 379 and includes a hollow portion 381 having a cross section of a circle and formed with them to penetrate through in the knob rotational axis direction.

A spring-receiving groove 382 is circumferentially formed in the body portion 377 and a return spring 384 is interposed between the body portion 377 and the second rotor 307. The tip 379 has an outer diameter greater than the through bore 335 of the push plate 331 and slightly smaller than the through bore 329 of the first rotor 305. An end face 380 of the tip 379 is in contact with the push plate 331.

A face plate 383 made of a translucent material is provided at an end of the conical portion 375 and constitutes a display. The hollow portion 381 of the knob 309 and the through bore 335 of the push plate 331 constitute an optical path penetrating from the LED 341 to the face plate 383. Illumination of the LED 341 causes an illuminating display of the face plate 383.

The knob 309 is inserted into the support cylinder 349 of the second rotor 307 and is rotatably engaged to the second rotor 307 in such a manner as to perform a pushing operation to the second rotor 307. This engagement can be made, for example, by engagement of a projection formed in the body portion 379 of the knob 309 to a slit formed in the knob rotational axis direction of the support cylinder 349. The engagement of the projection to the slit is made by snap fitting, preventing the knob 309 from coming off the second rotor 307.

Figure 15:
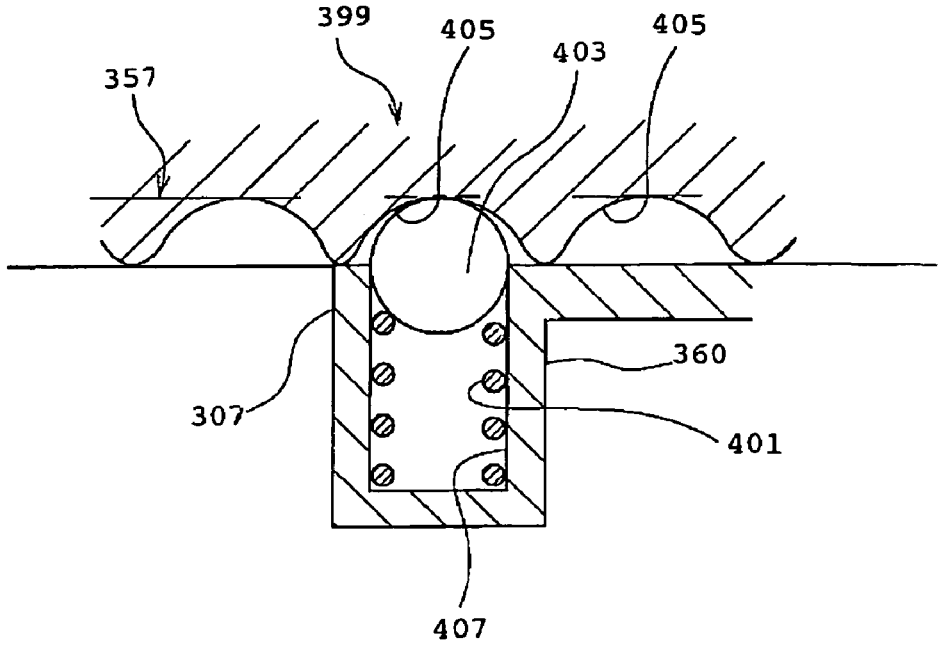
FIG. 15 is a partial cross section showing a rotational adjustment engagement portion between a second rotor and a second slider in the second embodiment.

The rotational adjustment engagement portion 399 is, as shown in FIGS. 11 and 15 provided between the second rotor 307 and the second slider 357 to provide a rotational adjustment of the second rotor 307 to the second slider 357. The rotational adjustment engagement portion 399 is formed of a ball 403 urged by a coil spring 401 located in the second rotor 307 as one of the second rotor 307 and the second slider 357 and an adjustment recess 405 formed in the second slider 357 as the other and engaged to the ball 403. The coil spring 401 and the ball 403 may be disposed in the second slider 357 and the adjustment recess 405 may be formed in the second rotor 307. The coil spring 401 and the ball 403 are received in each of receiving holes 407 formed at a plurality of locations in the knob circumferential direction of the second rotor 307 and each ball 403 flexibly contacts the adjustment recess 405 formed sequentially in the circumferential direction of the second slider 357.

The positioning engagement portion 385 between the first case 303 and the second slider 357 is made as shown in FIGS. 12 to 16. The positioning engagement portion 385 can be disengaged against a spring force and is formed of a ball 389 urged by a coil spring 387 located in the first rotor 5 as one of the case 303 and the second slider 357 and an adjustment recess 391 formed in the upper case 313 of the case 303 as the other and engaged to the ball 389. The coil spring 387 and the ball 389 may be disposed in the upper case 313 and the adjustment recess 391 may be formed in the second slider 357.

The coil spring 387 and the ball 389 are received in each of receiving holes 393 formed in positioning support portions 372 at a plurality of locations in the knob circumferential direction of the second slider 357 and each ball 389 flexibly contacts the adjustment recess 391 formed in the upper case 313.

The adjustment recess 391 is formed in a step shape, as composed of a central, positioning recess 395 and a returning recess 397 around the positioning recess 395.

[Parallel Operation]

The grip 373 of the knob 309 is gripped with a hand to perform a parallel operation of the knob 309 in any one of eight directions of A to H in FIG. 1. This operation causes the operation force of the knob 309 to be transmitted to the second rotor 307 through a connecting bore 353. This operation force is transmitted in the order of the second rotor 307, the second slider 357 and the first slider 355. The first slider 355 is guided along the side wall 365 of the upper case 313 for sliding and the second slider 357 slides to the first slider 355 by the slide groove 367 and the projecting portion 371. Cooperation of both slide movements of the first and second sliders 355 and 357 controls rotation of the second rotor 307 when the second rotor 307 moves in the knob rotational radial direction to the upper case 313. This rotation control allows the knob 309 to perform only the parallel operation in the knob rotational radial direction including the directions of A to H. In addition, this rotation control causes an effective function of the rotational adjustment engagement portion 399 between the second rotor 307 and the second slider 357.

Figure 17:
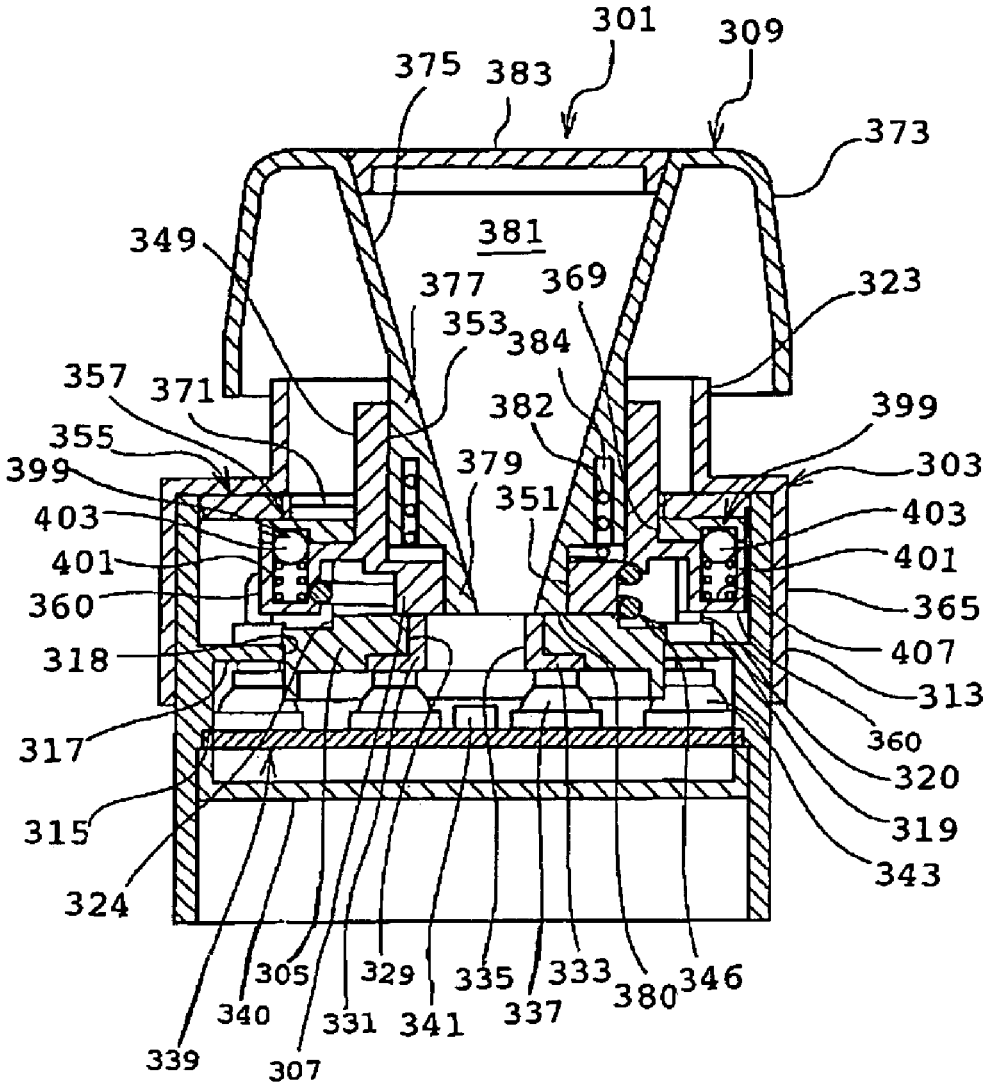
FIG. 17 is a cross section showing a parallel operation of the knob and corresponding to FIG. 11.

This parallel operation produces movement of the second rotor 307 from a state of FIG. 11 to a state of FIG. 17. This movement is allowed, caused by the coil spring 346 deflecting in the spring radial direction between the first and second rotor 305 and 307.

The movement of the second rotor 305 causes the tapered face 347 of the second slider 357 to push down the push rod 320 and compress the rubber contact 343, thereby activating the contact point. Even if the knob 309 rotates, since the second slider 357 does not rotate, the contact point can be activated by the parallel operation regardless of the rotation of the knob 309.

The push rod 320 is located at a pitch of 90 degrees. Therefore, when the knob 309 is operated in the direction of the push rod 320, the contact point in that direction of the rubber contacts 343 turns on. When the knob 309 is operated in the intermediate direction between two push rods 320, the two push rods 20 turn on at the same time. Accordingly, operations in the eight directions can be detected with four rubber contacts 343.

When the knob 309 performs a parallel operation, the end face 380 of the tip 379 of the knob 309 is engaged on the first rotor 305, blocking the pushing operation of the knob 309.

Figure 16:
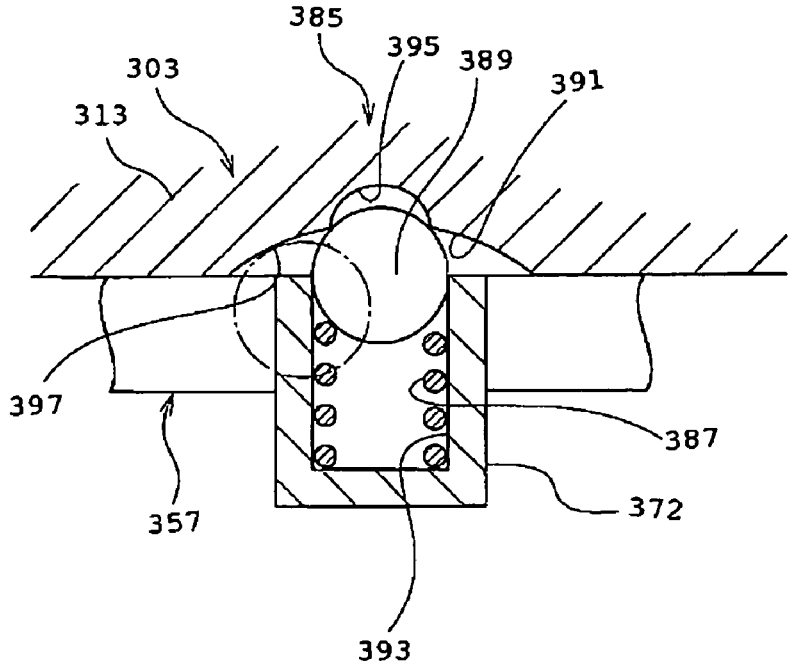
FIG. 16 is a partial cross section showing a positioning engagement portion between the case and the second slider in the second preferred embodiment.

When the second rotor 307 moves as shown in FIG. 17, the ball 389 urged by the coil spring 387 is out of the positioning recess 395 and relatively moves onto the returning recess 397 as shown in a dashed line of FIG. 16. As the ball 389 moves onto the returning recess 397 out of the positioning recess 395, the reaction is provided to the knob 309 to produce an operation adjustment feeling.

The movement of the ball 389 causes the ball 389 to be pushed down into the direction of the receiving hole 393 against the urging force of the coil spring 387. Accordingly, when the operation force of the knob 309 is eliminated, the ball 389 comes out of the receiving hole 393 by the urging force of the coil spring 387 and returns from the returning recess 397 to the positioning recess 395 for the second rotor 307 to be positioned therein. At the same time the rubber contact 343 compressed by the push rod 320 also flexibly returns and applies a returning force to the oblique face 47 through the push rod 320. Accordingly, the second rotor 307 is securely moved to a neutral position before the parallel operation is performed and the knob 309 automatically returns back to the previous position before the operation is performed.

[Rotational Operation]

When the grip 373 of the knob 309 is operated for rotation, the rotational force is transmitted from the body portion 377 to the support cylinder 349 of the second rotor 307, so that the second rotor 307 rotates around the axis. The second rotor 307 transmits the rotation to the first rotor 305 through the coil spring 346. The rotation of the first rotor 305 causes relative rotational movement of the comb tooth portion 327 to the photo sensor 345.

At the time of the rotation operation of the knob 309, the second rotor 307 rotates relatively to the second slider 357. Therefore, the ball 403 urged by the coil spring 401 goes over the adjustment recess 405, thereby producing an adjustment feeling.

[Pushing Operation]

When the knob 309 performs a pushing operation, the body portion 377 is pushed into the support cylinder 349 and moves in the axial direction. The pushing force of the knob 309 is transmitted from the end face 380 of the tip 379 to the push plate 331, compressing the rubber contact 337. With this, the rubber contact 337 is activated and the contact point turns on, so that the pushing operation can be detected.

During this pushing operation, the tip 379 of the knob 309 is fitted into the through bore 329 of the first rotor 305. Therefore, the parallel operation of the knob 309 is impossible.

When an operator releases its hand from the knob 309, the pushing force of the rubber contact 337 is eliminated and the knob 309 is pushed up by the spring returning forces of the return spring 384 and the rubber contact 337. It should be noted that the return spring 384 for returning the knob 309 may be omitted.

[Illumination]

When the LED 341 emits light, the light passes through the through bore 335 of the push plate 331 and the hollow portion 381 of the knob 309 and directly reaches the face plate 383. This light allows the face plate 383 to perform illuminating display.

[Effect of the Second Preferred Embodiment]

A parallel operation, a rotational operation and a pushing operation of the knob 309 can be performed without replacing one knob with the other.

The knob 309 can perform the rotational operation and the pushing operation and besides, the parallel operation without the inclining operation. Therefore, it is not required to have the switch structure where the inclining operation is artificially close to the parallel operation, making it possible to carry out downsizing of the entire switch structure.

Since the single substrate 339 has the rubber contacts 337 and 343 and the photo sensor 345 as detecting portions thereon which are individually operated by the parallel operation, the rotational operation and the pushing operation of the knob 309, the number of components can be reduced and easy management of mounting components can be made. In addition, the switch structure can be entirely downsized.

While only selected preferred embodiments have been chosen to illustrate the present invention, it will be apparent to those skilled in the art from this disclosure that various changes and modifications can be made herein without departing from the scope of the invention as defined in the appended claims. Furthermore, the foregoing description of the preferred embodiments according to the present invention is provided for illustration only, and not for the purpose of limiting the invention as defined by the appended claims and their equivalents.

What is claimed is:

1. A multi directional input apparatus comprising:

a knob supported to be capable of performing a parallel operation, a rotational operation and a pushing operation relative to a case;

a first rotor disposed to be rotatable relative to the case;

a second rotor which is positioned face to face and adjacent to the first rotor in a direction of a knob rotational axis, disposed to be rotatable relative to the case and movable in a direction perpendicular to the knob rotational axis to the case, and further which is movable in the direction of the knob rotational axis to the knob and rotates together with the knob;

a connecting member disposed between the first rotor and the second rotor to allow movement of the second rotor in the direction perpendicular to the knob rotational axis relative to the first rotor and performs rotational transmission between the first rotor and the second rotor, and a single substrate provided with a detecting portion for detecting each of the parallel operation, the rotational operation and the pushing operation of the knob.

2. The multi directional input apparatus according to claim 1, wherein:

the connecting member is constructed of a positioning member disposed to be disengaged against urging forces.

3. The multi directional input apparatus according to claim 2, wherein:

the positioning engagement portion includes:

a ball disposed in one of the first rotor and the second rotor and urged by a coil spring; and an adjustment recess disposed in a remaining one of the first rotor and the second rotor and engaged to the ball.

4. The multi directional input apparatus according to any one of claims 1 to 3, wherein:

the second rotor includes a tapered face, the apparatus further comprising:

a plurality of push rods disposed circumferentially about the knob rotational axis in a knob circumferential direction of the case so that when the second rotor moves in the knob radial direction, at least one push rod contacts the tapered face to move the at least one push rod parallel to the knob rotational axis, thus activating the detecting portion corresponding to the push rod.

5. The multi directional input apparatus according to any one of claims 1 to 3, wherein:

the second rotor is movable and rotatable relative to the knob rotational axis and relative to the case through a first slider and a second slider;

the first slider is disposed movable in one direction relative to the case; and the second slider is disposed in a direction perpendicular to the one direction of the first slider.

6. The multi directional input apparatus according to claim 5, further comprising:

a rotational adjustment engagement portion disposed between the second rotor and the second slider for providing rotational adjustment of the second rotor to the second slider.

7. The multi directional input apparatus according to claim 6, wherein:

the rotational adjustment engagement portion includes:

a ball disposed in one of the second rotor and the second slider and urged by a coil spring; and an adjustment recess disposed in the other and engaged to the ball.

8. The multi directional input apparatus according to any one of claims 1-3, further comprising:

an illuminator disposed on the substrate;

a display in a top plate of the knob; and a light path penetrating from the illuminator to the display, wherein:

illuminating the display is made by illumination of the illuminator.

9. The multi directional input apparatus according to claim 1, wherein the connecting member is constructed of a flexible member.

10. The multi directional input apparatus according to claim 9, wherein:

the flexible member includes a coil spring both end portions of which are connected individually to the first rotor and the second rotor.

11. The multi directional input apparatus according to claim 9 or 10, wherein:

the second rotor is movable and rotatable in the knob rotational, radial direction to the case through the first slider and the second slider;

a first slider movable in one direction relative to the case; and a second slider movable in a direction perpendicular to the one direction of the first slider.

12. The multi directional input apparatus according to claim 11, wherein:

the second slider includes an oblique face, the apparatus further comprising:

a plurality of push rods disposed circumferentially about the knob rotational axis so that when the second rotor moves in the direction perpendicular to the knob rotational axis, at least one push rod contacts the tapered face to move the at least one push rod parallel to the knob rotational axis, thus activating the detecting portion corresponding to the push rod.

13. The multi directional input apparatus according to claim 11, further comprising:

a positioning engagement portion disposed between the case and the second slider to allow movement of the second slider in the direction of the knob rotational axis relative to the first rotor and also be disengaged against urging forces.

14. The multi directional input apparatus according to claim 13, wherein:

the positioning engagement portion includes:

a ball disposed in one of the case and the second slider and urged by a coil spring; and an adjustment recess disposed in a remaining one of the case and the second slider and engaged to the ball.

15. The multi directional input apparatus according to claim 11, further comprising:

a rotational adjustment engagement portion disposed between the second rotor and the second slider for providing rotational adjustment of the second rotor with respect to the second slider.

16. The multi directional input apparatus according to claim 15, wherein:

the rotational adjustment engagement portion includes:

a ball disposed in one of the second rotor and the second slider and urged by a coil spring; and an adjustment recess disposed in a remaining one of the second rotor and the second slider and engaged to the ball.

17. The multi directional input apparatus according to claim 9 or 10, wherein:

the first rotor includes a through bore formed therein in such a manner that when the knob is in a neutral position, a tip of the knob is positioned as opposed to the through bore to be allowed to be fitted into the through bore and when the knob is moved in the direction perpendicular to the knob rotational axis, the tip of the knob is positioned out of the through bore to be incapable of being fitted into the through bore, the apparatus further comprising:

a push member located in the through bore to be pushed into the through bore, thereby activating the detecting portion corresponding to the pushing operation of the knob.

18. The multi directional input apparatus according to claim 9 or 10, further comprising:

an illuminator disposed on the substrate;

a display in a top plate of the knob; and a light path penetrating from the illuminator to the display, wherein:

illuminating the display is made by illumination of the illuminator.

* * * * *